US010260409B2

(12) United States Patent
Johnson et al.

(10) Patent No.: US 10,260,409 B2
(45) Date of Patent: Apr. 16, 2019

(54) SCALABLE ELECTRICAL POWER GENERATOR SET AND RELATED METHODS

(71) Applicant: EVOLVE HOLDINGS, INC., Houston, TX (US)

(72) Inventors: Tye Johnson, Houston, TX (US); Bo Williamson, Houston, TX (US); Clay Bludau, Houston, TX (US)

(73) Assignee: EVOLVE HOLDINGS, INC., Houston, TX (US)

( * ) Notice: Subject to any disclaimer, the term of this patent is extended or adjusted under 35 U.S.C. 154(b) by 289 days.

(21) Appl. No.: 15/042,239

(22) Filed: Feb. 12, 2016

(65) Prior Publication Data

US 2017/0237264 A1 Aug. 17, 2017

(51) Int. Cl.
*F02B 63/04* (2006.01)

(52) U.S. Cl.
CPC ..... *F02B 63/044* (2013.01)

(58) Field of Classification Search
None
See application file for complete search history.

(56) References Cited

U.S. PATENT DOCUMENTS

| | | | | |
|---|---|---|---|---|
| 4,835,405 | A | 5/1989 | Clancey et al. | |
| 6,784,560 | B2 | 8/2004 | Sugimoto et al. | |
| 7,314,397 | B2 | 1/2008 | Sodemann et al. | |
| 7,557,458 | B2 | 7/2009 | Yamamoto et al. | |
| 8,427,005 | B1 * | 4/2013 | Kisner | H02J 3/16 307/18 |
| 8,881,694 | B2 | 11/2014 | Gillett et al. | |
| 9,143,018 | B2 | 9/2015 | White et al. | |
| 9,181,865 | B2 | 11/2015 | Richardson et al. | |
| 9,212,499 | B1 * | 12/2015 | Maurer | E04H 5/04 |
| 9,252,640 | B2 | 2/2016 | Gillett et al. | |

* cited by examiner

*Primary Examiner* — Thienvu V Tran
*Assistant Examiner* — David M Stables
(74) *Attorney, Agent, or Firm* — Mossman, Kumar & Tyler PC

(57) ABSTRACT

A system for generating electrical power includes engine generators positioned on a pad and housed within an enclosure. The pad may have a first side having an associated long axis and a shorter second side having an associated short axis. The short axis is transverse to the long axis. The engine generators are electrically coupled to one another in a parallel fashion. Each engine generator includes a prime mover and an alternator that are serially aligned with the short axis of the pad. The enclosure encloses the engine generators and has a plurality of side walls, a roof, and a floor. The enclosure includes at least one intake opening formed in the floor to provide airflow into an interior of the enclosure.

15 Claims, 4 Drawing Sheets

SCALABLE ELECTRICAL POWER GENERATOR SET AND RELATED METHODS

CROSS REFERENCE TO RELATED APPLICATIONS

None

TECHNICAL FIELD

The present disclosure relates to devices and methods for generating electrical power.

BACKGROUND

Electrical power generator sets are employed in a variety of situations as a primary or a back-up source of electrical power. Illustrative, but not exhaustive, applications for such generator sets include remote locations such as constructions sites or facilities such as hospitals or schools. Traditional configurations for electrical power generator sets are disclosed in U.S. Pat. Nos. 4,835,405, 6,784,560, 7,314,397, 7,557,458, 8,881,694, 9,143,018, 9,181,865, and 9,252,640.

Electrical power generator sets according to the present teachings may provide a variety of advantages over traditional power generator sets, including enhanced scalability, flexibility in maintenance, lower capital costs, and higher resistance to adverse weather conditions.

SUMMARY

In aspects, the present disclosure provides a system for generating electrical power. The system may include a pad, a plurality of engine generators, and an enclosure. The pad may have a first side with an associated long axis and a shorter second side with an associated short axis. The short axis is transverse to the long axis. The engine generators are positioned on the pad and are electrically coupled to one another in a parallel fashion. Each engine generator includes a prime mover and an alternator that are serially aligned with the short axis of the pad. The enclosure encloses the engine generators and has a plurality of side walls, a roof, and a floor. The enclosure includes at least one intake opening formed in the floor to provide airflow into an interior of the enclosure.

In aspects, the present disclosure provides a method for generating electrical power. The method may include positioning a plurality of engine generators on a pad, electrically coupling the plurality of engine generators to one another in a parallel fashion, enclosing the engine generators with an enclosure, and electrically connecting the engine generators to an energy consumer The engine generators, pad, and enclosure may be the same as that described above.

It should be understood that certain features of the disclosure have been summarized rather broadly in order that the detailed description thereof that follows may be better understood, and in order that the contributions to the art may be appreciated. There are, of course, additional features of the disclosure that will be described hereinafter and which will in some cases form the subject of the claims appended thereto.

BRIEF DESCRIPTION OF THE DRAWINGS

For detailed understanding of the present disclosure, references should be made to the following detailed description taken in conjunction with the accompanying drawings, in which like elements have been given like numerals and wherein.

DETAILED DESCRIPTION

Figure 1:
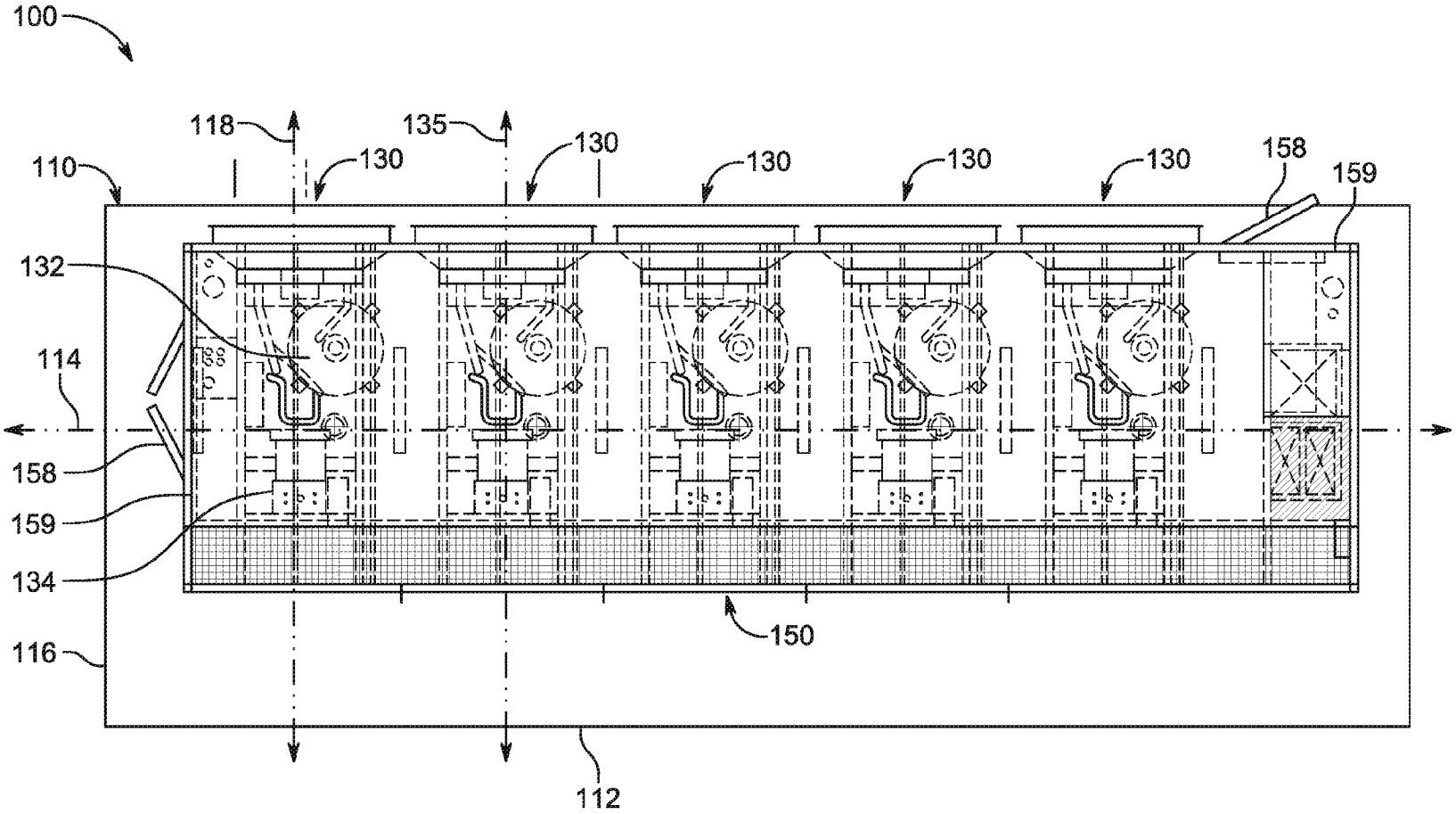
FIG. 1 schematically illustrates a top view of a generator set according to one embodiment of the present disclosure.

The present disclosure relates to devices and methods for generating electrical power for one or more energy consumers. The present disclosure is susceptible to embodiments of different forms. There are shown in the drawings, and herein will be described in detail, specific embodiments of the present disclosure with the understanding that the present disclosure is to be considered an exemplification of the principles of the disclosure, and is not intended to limit the disclosure to that illustrated and described herein.

Referring to FIG. 1, there is schematically illustrated one embodiment of an electrical power generator set 100 made in accordance with the present disclosure. The generator set 100 may include a pad 110, a plurality of engine generators 130, and an enclosure 150.

The pad 110 provides a common structural foundation for the engine generators 130 and the enclosure 150. In one arrangement, the pad 110 may be defined as having a long side 112 with an associated long axis 114 and a short side 116 with an associated short axis 118. As shown, the long side 112 is dimensioned to be longer than the short side 116 and the short axis 118 is transverse to the long axis 114.

The engine generators 130 are configured to provide electrical power on a primary and/or standby basis to an energy consumer (i.e., equipment that uses electrical power) located at a temporary work site or a permanent facility. While five engine generators 130 are shown, any number of engine generators 130 may be used. In one arrangement, the engine generators 130 include a prime mover 132 such as an internal combustion engine, a diesel engine, a rotary engine, or the like, and an alternator 134 that converts kinetic energy into electrical energy.

In arrangements, the number and power ratings of the engine generators 130 are selected to cooperatively meet a specified power demand. That is, each engine generator 130 generates a fraction or portion of the overall power demand. Thus, for example, if a particular energy consumer requires 2000 kw of power to be available, then five generators 130, each having a rating of 400 kw, may be used. Moreover, additional generators may be integrated to add redundancy with the parallel electric bus. Further, each of these five generators 130 may be connected in an electrically parallel fashion. Thus, one or more of these five generators 130 may be taken offline (i.e., deactivated) without disrupting the power output of the generator(s) 130 that are still online and providing electrical power.

It should be appreciated that the modular and autonomous nature of the engine generators 130 may provide several advantages. First, engine generators 130 may be incrementally added to the generator set 100 as demand increases over time. In many instances, a specified peak power demand occurs months or even years after a facility has been completed. At facility start-up, the power requirements may be only a minor percentage of the specified peak power demand. In such instances, only the number of engine generators 130 required to meet the immediate power demands need to be purchased and installed. As should be appreciated, instead of immediately incurring a relatively large capital cost to acquire a generator set 100 to meet the specified peak power demand, engine generators 130 can be acquired over time, which spreads the capital costs over a period time and enables users to deploy their capital elsewhere.

Second, maintenance on the generator set 100 may be performed without interrupting power availability to the user. That is, routine maintenance can be performed by taking one engine generator 130 offline while the online generators 130 continue to supply electrical power. Such ability is especially significant when considering life safety applications or facilities.

Third, use of multiple and parallel engine generators 130 provide inherent redundancy in the generator set 130; i.e., a failure in one engine generator 130 will not terminate all power to the user. Thus, a single point of failure will not take the entire generator set 100 offline.

Referring to FIGS. 1 and 2, the enclosure 150 is configured to house and protect the engine generators 130. It should be noted that the engine 132 and the alternator 134 are serially aligned along an axis 135 that is aligned with the short axis 118 (i.e., transverse to the long axis 114 of the pad 110). By serially aligned, it is meant that the engine 132 and the alternator 134 are positioned "end-to-end" as opposed "side-by-side," which of course allows the rotational energy of the engine 132 to drive the alternator 134. Thus, in one aspect, the axis of rotary motion of the engine 132/alternator 134 is parallel with the short axis 118. This orientation and arrangement allows the engine generators 130 to occupy the same "footprint" or area as a single engine generator that has the equivalent power rating.

Figure 2A:
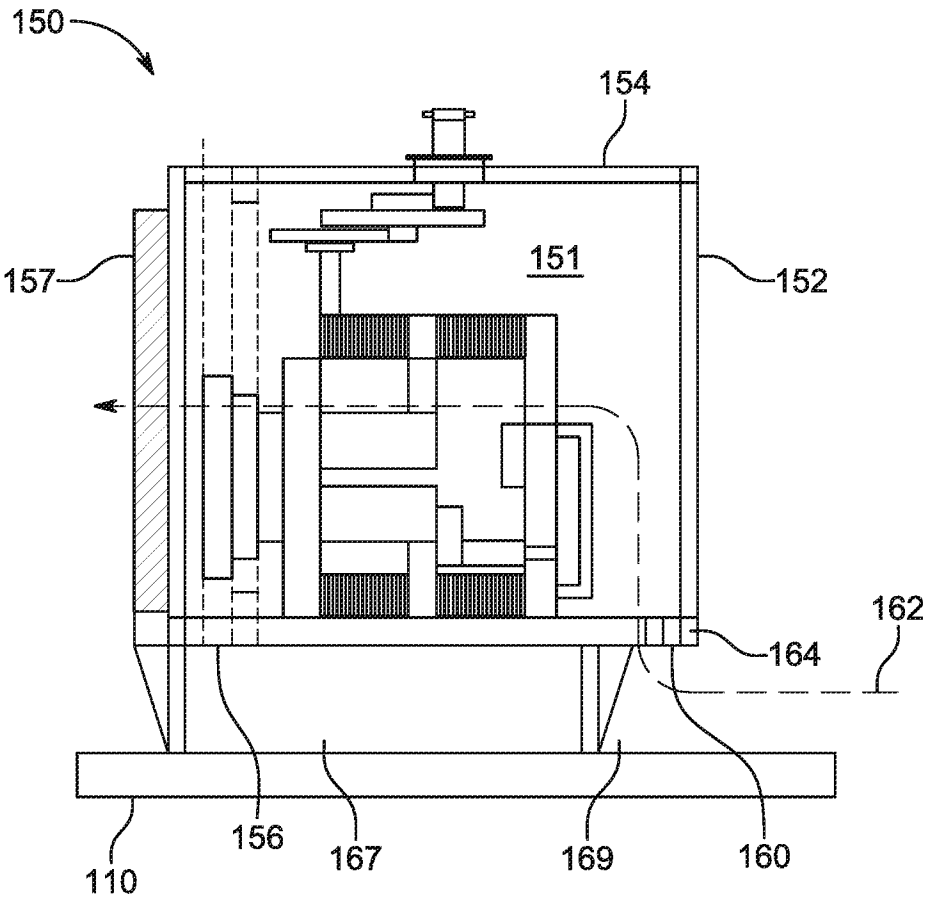
FIGS. 2A-B schematically illustrate a side view of the FIG. 1 embodiment and FIG. 3 illustrates a modular enclosure according to one embodiment of the present disclosure.
Figure 2B:
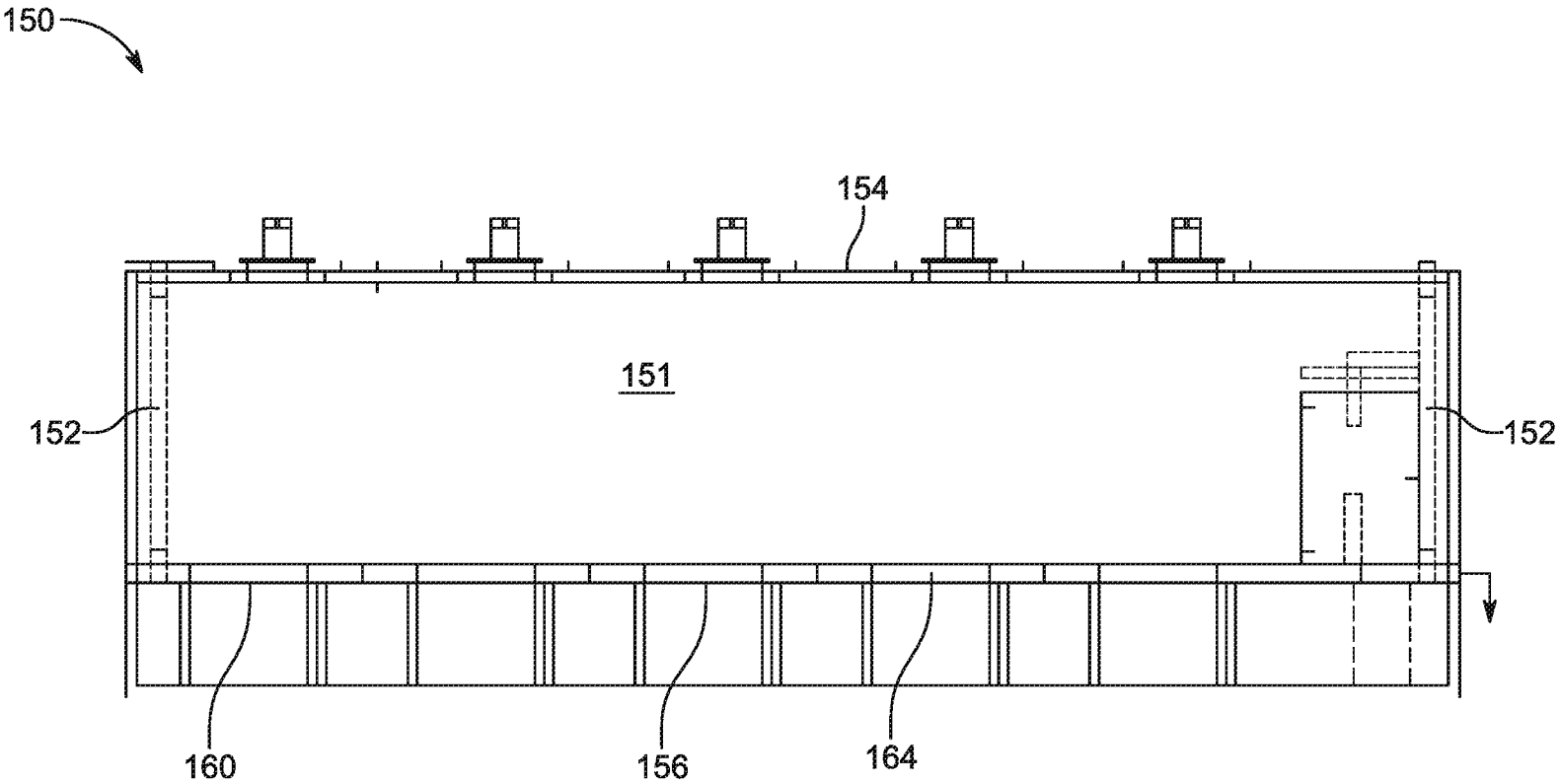

Referring to FIGS. 2A and 2B, the enclosure 150 has an interior 151 defined by vertically oriented side walls 152, a roof 154, a floor 156, and a sub-base fuel tank 167. Personnel can access the interior of the enclosure 150 via doors 158 that selectively close entrances 159 (FIG. 1) formed in the side walls 152. Additionally, the airflow into the enclosure 150 is controlled using intake openings 160 formed in the floor 156 of the enclosure 150. The intake openings 160 may include structures such as louvers, vents, baffles, or other air flow control features. It is emphasized that the doors 158 (FIG. 1) and intake openings 160 are distinctly different penetrations in the enclosure 150. The doors 158 are principally designed to allow the movement of personnel and equipment into and out of the enclosure 150. The doors 159 may be kept open or closed while the engine generators 130 are running. In contrast, the intake openings 160 are intended to allow only the flow of gases into the enclosure 130. Moreover, keeping the intake openings 160 open is generally considered necessary while the engine generators 130 are running. In one embodiment, the intake openings 160 may be distributed along an edge 164 of the floor 156. In other embodiments, the intake openings 160 may be distributed at more than one edge 164 or closer to a middle location of the floor 156.

In embodiments, the only intake openings 160 for the enclosure 150 are formed in the floor 156. As best seen in FIG. 2A, the over-hanging edge 164 forms a space 169 between the pad 110 and the floor 156. The space 169 is adjacent to the sub-base fuel tank 167. The intake openings 160 may be formed as passages that are oriented in order to flow air vertically upward from that space to the interior 151 as shown by arrow 162. It should be noted that downwardly flowing fluid or horizontally flowing fluid cannot directly enter the intake openings 160.

Air exiting the interior 151 flows in a horizontal direction through a vent 157 such as a louver in one or more of the side walls 152. Thus, in one arrangement, air flows vertically upward into the interior 151 via the intake openings 160 and horizontally out of the interior 151 via the louvers 157. In some embodiments, the flow of air from the intake opening 160 to the vent 157 is generally parallel with the short axis 118. In other embodiments, additional intake openings 160 may be formed in other locations, such as the side walls 152 and/or the roof 154, in addition to the floor 156.

It should be appreciated that positioning the openings 160 under the enclosure 150 reduce the chances of rain, dust, debris, or other unwanted materials from entering the enclosure 150. For instance, rain falling vertically or being driven horizontally by wind would not have a direct path into the interior 151 of the enclosure 150. Thus, generator sets according to the present disclosure can prevent water penetration and mitigate risk of such fluids from contacting live electrical components and thereby increase personnel safety.

Figure 3:
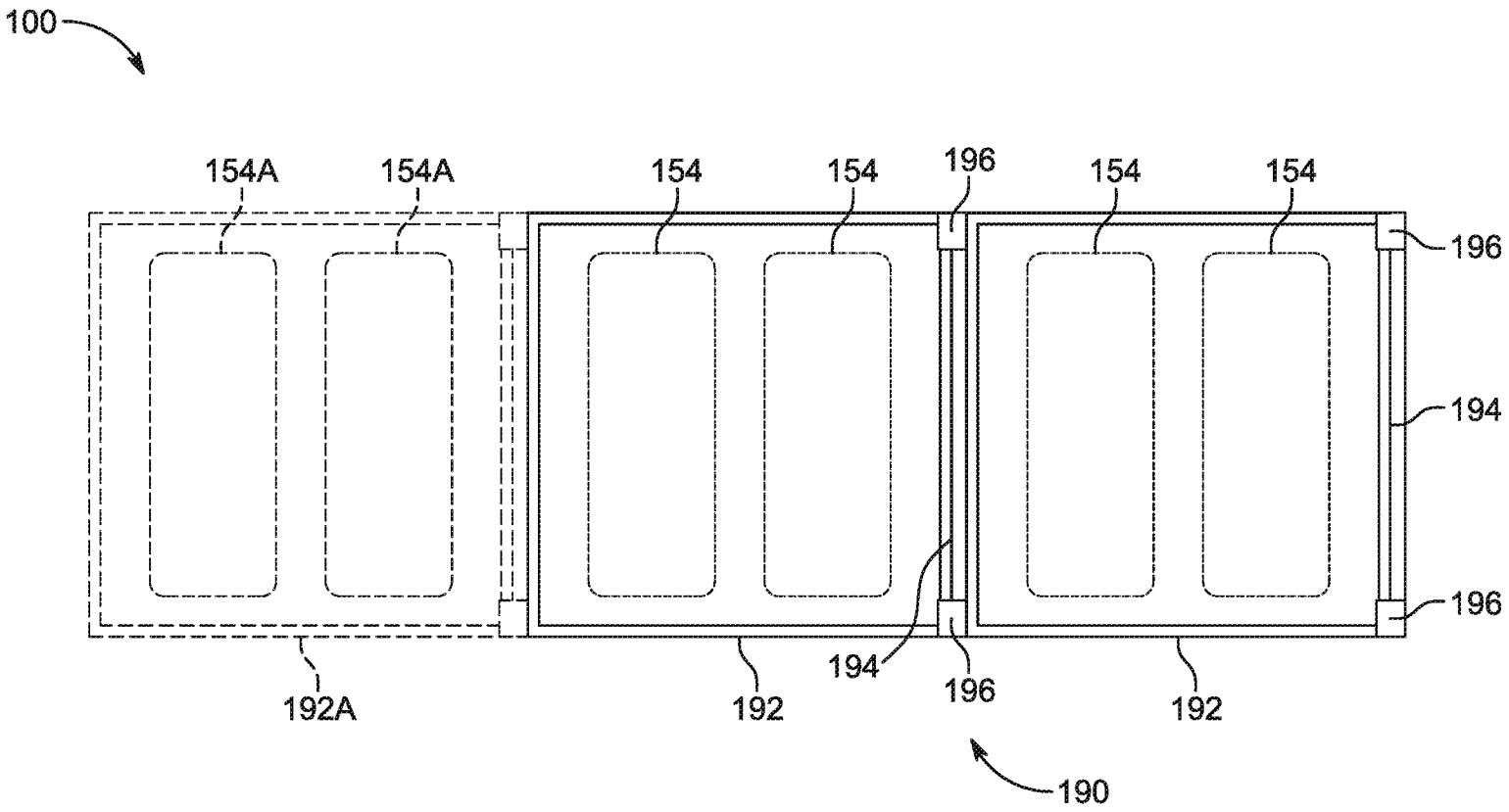

It should be understood that the teaching of the present disclosure are susceptible to numerous variants. One non-limiting variant is shown in FIG. 3, which schematically illustrates a modular enclosure 190. The modular enclosure 190 is similar to the enclosure 150 shown in FIG. 1. However, the modular enclosure 190 is constructed of individual housing modules 192. Each module 192 is a self contained structure sized to hold a generator set 100 having a specified number of engine generators 154. A generator set 100 having four engine generators 154 are shown merely for illustration. Each module 192 includes side walls 194 that are configured to interlock with the side walls 194 of an adjacent module 192. For example, fastening elements 196 may be used to fix two modules 192 to one another. Of course, other features such as seals (not shown) may be at the connection interfaces.

It should be appreciated that the FIG. 3 embodiment allows a generator set 100 to be reconfigured to accommodate changes in electrical power consumption demands. For example, a generator set 100 may initially require four engine generators 154 as shown. Thus, two modules 192 may be assembled to furnish the internal volume to accommodate these engine generators 154. At a later time, electrical power demands may necessitate the addition of two more engine generators 154A. Advantageously, such an increase can be easily accommodated by the FIG. 3 embodiment because a third module 192A may simply be added to thereby furnish the internal capacity to hold the additional two engine generators 154A. It should be understood that separate modules (not shown) of a similar construction may be used to house electrical equipment and other ancillary devices.

The foregoing description is directed to particular embodiments of the present disclosure for the purpose of illustration and explanation. It will be apparent, however, to one skilled in the art that many modifications and changes to the embodiment set forth above are possible without departing from the scope of the disclosure. It is intended that the following claims be interpreted to embrace all such modifications and changes.

What is claimed is:

1. A system for generating electrical power, comprising:

a sub-base fuel tank positioned on a structural foundation, the structural foundation being defined by a first side and a shorter second side, the first side having an associated long axis that is parallel with the first side and the second side having an associated short axis that is parallel with the second side, the short axis being transverse to the long axis;

a plurality of engine generators electrically coupled to one another in a parallel fashion, each engine generator including a prime mover and an alternator, the prime mover and the alternator being serially aligned with the short axis of the structural foundation; and an enclosure enclosing the plurality of engine generators and positioned above the sub-base fuel tank, the enclosure having a plurality of side walls, a roof, and a floor, wherein the enclosure includes at least one intake opening formed in the floor to provide airflow into an interior of the enclosure and at least one vent formed on at least one of the plurality of side walls, the at least one intake opening and the at least one vent being positioned to direct air flow upward and through the interior of the enclosure.

2. The system of claim 1, wherein a space separates the structural foundation from the floor, and wherein the at least one intake opening is oriented to flow air vertically upward into the interior through the floor after the air flows between the floor and the structural foundation.

3. The system of claim 2, wherein the at least one intake opening includes a plurality of openings distributed along an edge of the floor and along the long axis.

4. The system of claim 2, wherein the space is formed by a gap between the structural foundation pad and an edge of the floor that overhangs the sub-base fuel tank.

5. The system of claim 2, wherein the at least one intake opening includes a plurality of openings distributed along an edge of the floor, and wherein a flow of air from the at least one intake opening to the at least one vent is parallel with the short axis.

6. The system of claim 1, wherein the at least one intake opening and the at least one vent are positioned on opposite sides of the shorter second side.

7. The system of claim 1, wherein a flow of air from the at least one intake opening to the at least one vent is parallel with the short axis.

8. The system of claim 1, wherein the at least one enclosure is formed of a plurality of housing modules.

9. A method for generating electrical power, comprising:

positioning a sub-base fuel tank on a structural foundation defined by a first side and a shorter second side, the first side having an associated long axis that is parallel with the first side and the second side having an associated short axis that is parallel with the second side, the short axis being transverse to the long axis electrically coupling a plurality of engine generators to one another in a parallel fashion, each engine generator including a prime mover and an alternator;

enclosing the plurality of engine generators within an enclosure, the enclosure having a plurality of side walls, a roof, and a floor, wherein the enclosure includes at least one intake opening formed at the floor to provide airflow into an interior of the enclosure and at least one vent formed on at least one of the plurality of side walls, the at least one intake opening and the at least one vent being positioned to direct air flow upward and through the interior of the enclosure;

positioning the enclosure above the sub-base fuel tank, the sub-base fuel tank being outside the enclosure; and electrically connecting the engine generators to an energy consumer.

10. The method of claim 9, wherein the energy consumer has a peak power requirement; and further comprising:

configuring each of the engine generators to provide only a fraction of the peak power requirement.

11. The method of claim 9, further comprising:

supplying electrical power to the energy consumer while at least one of the engine generators is offline.

12. The method of claim 9, further comprising:

flowing air vertically through the floor into the interior via the at least one intake opening; and flowing air parallel to the short axis of the pad to the at least one vent, the at least one vent being formed in at least one sidewall of the enclosure that is opposite to the at least one vent.

13. The method of claim 9, wherein the enclosure is formed of a plurality of housing modules, and further comprising:

increasing a volume of the interior by increasing the number of housing modules forming the enclosure.

14. The method of claim 9, further comprising:

flowing air from a space separating the structural foundation pad from the floor via the at least one intake opening into the interior of the enclosure, wherein the at least one intake opening is oriented to flow air vertically upward into the interior.

15. A system for generating electrical power, comprising:

a sub-base fuel tank positioned on a structural foundation defined by a first side and a shorter second side, the first side having an associated long axis that is parallel with the first side and the second side having an associated short axis that is parallel with the second side, the short axis being transverse to the long axis; and an enclosure having a plurality of side walls, a roof, and a floor, wherein:

the enclosure includes at least one intake opening formed in the floor to provide airflow into an interior of the enclosure through the floor, a space separates the structural foundation from the floor, the space being formed by a gap between the structural foundation and an overhanging edge of the floor, and the at least one intake opening is oriented to flow air vertically upward into the interior through the floor;

a plurality of engine generators in the interior of the enclosure and electrically coupled to one another in a parallel fashion, each engine generator including a prime mover and an alternator, the prime mover and the alternator being serially aligned with the short axis of the pad;

wherein the sub-base fuel tank is positioned outside of the enclosure and in the space between the floor and the structural foundation.

* * * * *